US009113699B2

(12) United States Patent
Radosta

(10) Patent No.: US 9,113,699 B2
(45) Date of Patent: Aug. 25, 2015

(54) HANDS-FREE HYDRATION APPARATUS

(71) Applicant: John Anthony Radosta, Fort Lauderdale, FL (US)

(72) Inventor: John Anthony Radosta, Fort Lauderdale, FL (US)

( * ) Notice: Subject to any disclaimer, the term of this patent is extended or adjusted under 35 U.S.C. 154(b) by 21 days.

(21) Appl. No.: 14/556,900

(22) Filed: Dec. 1, 2014

(65) Prior Publication Data

US 2015/0083762 A1 Mar. 26, 2015

(51) Int. Cl.

| | |
|---|---|
| ***A45F 3/20*** | (2006.01) |
| *A45F 5/00* | (2006.01) |
| *A45F 3/00* | (2006.01) |

(52) U.S. Cl.

CPC ..... *A45F 3/20* (2013.01); *A45F 2003/006* (2013.01); *A45F 2005/008* (2013.01)

(58) Field of Classification Search

CPC ..... A45F 2005/008; A45F 5/00; A45F 2003/166; A45F 2003/006; A45F 3/20; A45F 3/16

USPC ..... 224/148.1–148.7, 218–222

See application file for complete search history.

(56) References Cited

U.S. PATENT DOCUMENTS

| | | | | | |
|---|---|---|---|---|---|
| 4,330,120 | A | * | 5/1982 | Netti | 482/105 |
| 4,988,097 | A | * | 1/1991 | Smith et al. | 482/105 |
| D323,430 | S | * | 1/1992 | Niederkorn | D3/202 |
| 5,472,125 | A | * | 12/1995 | Barnard | 224/219 |
| 5,566,869 | A | * | 10/1996 | Katz | 224/148.6 |
| 5,607,090 | A | * | 3/1997 | Brown | 224/217 |
| 5,938,089 | A | * | 8/1999 | Abreu-Marston | 224/148.5 |
| 8,622,262 | B2 | * | 1/2014 | Van Art | 224/148.2 |
| 2010/0001022 | A1 | * | 1/2010 | McInerney | 222/175 |

* cited by examiner

*Primary Examiner* — Brian D Nash
*Assistant Examiner* — Corey Skurdal
(74) *Attorney, Agent, or Firm* — James M. Smedley LLC; James Michael Smedley, Esq.

(57) ABSTRACT

The present invention generally relates to wearable hydration apparatuses. In particular, embodiments of the apparatus are configured to be worn on a forearm of a user and provide hydration to the user via a mouthpiece connected to a bladder in the apparatus that is configured to hold liquid such that the liquid is displaced over the entire shape of the user's forearm. In preferred embodiments, the mouthpiece of the apparatus may be engaged through a biting or other action applied to the mouthpiece via the user's mouth.

15 Claims, 3 Drawing Sheets

HANDS-FREE HYDRATION APPARATUS

CROSS REFERENCE TO RELATED APPLICATIONS

This present application claims the benefit of U.S. Provisional Patent Application No. 62/005,094 filed May 30, 2014, the entire disclosures of which are incorporated herein by reference.

FIELD OF THE INVENTION

The present invention generally relates to wearable hydration apparatuses. In particular, embodiments of the apparatus are configured to be worn on a forearm of a user and provide hydration to the user via a mouthpiece connected to a bladder in the apparatus that is configured to hold liquid such that the liquid is displaced over the entire shape of the user's forearm. In preferred embodiments, the mouthpiece of the apparatus may be engaged through a biting or other action applied to the mouthpiece via the user's mouth.

BACKGROUND OF THE INVENTION

Carrying water or any other beverage during physical activity and exercise is both cumbersome and restrictive. The user is also unable to utilize that hand for other tasks such as lifting objects or weights.

Other hydration devices currently available are bulky, chafe the user, and are not practical or otherwise function poorly in liquid disbursement. These hydration devices have not been adapted to the user's drinking motion, nor are they comfortable to wear.

Further, in other hydration devices currently available, gravity causes fluids to flow away from the uptake valve during the drinking motion which can make drinking impossible.

Therefore, there is a need in the art for a wearable hands-free hydration apparatus that does not restrict the movement or utilization of a hand of the user or otherwise chafe or provide inadequate liquid disbursement. These and other features and advantages of the present invention will be explained and will become obvious to one skilled in the art through the summary of the invention that follows.

SUMMARY OF THE INVENTION

Accordingly, embodiments of the present invention overcome the deficiencies of prior art apparatuses by dealing with three fundamental forces that cause the problem with other devices: gravity, fluid dynamics, and inertia. In embodiments of the present invention, fluid flows towards the uptake valve during the drinking motion. Further, the embodiments of the present invention also combats fluid dynamics, specifically a fluid's tendency to concentrate in a particular area due to gravitational force by utilizing a barrier in the form of a weld seam to compartmentalize the liquid, which results in an even disbursement of fluid throughout the bladder. Also, embodiments of the present invention overcome problems with inertia by being securely fastened to the arm of the user, which reduces bouncing/movement and thus, chafing.

According to an embodiment of the present invention, a Hands free hydration apparatus includes: a wearable portion, comprising an apparatus body, one or more attachment means, a thumb strap attachment means; and a liquid storage, intake, and dispensing element, comprising a bladder, a fill cap, an uptake valve, a hose, and mouthpiece, wherein the bladder is contained within the wearable portion, wherein the fill cap is attached to the bladder and extends through the wearable portion to allow for insertion of a fluid into the bladder through the fill cap, wherein the uptake valve is contained within the wearable portion and connected to the bladder and provides for passage of the fluid from the bladder to the hose, wherein the hose is connected to the uptake valve and allows for passage of the fluid from the uptake valve to the mouthpiece, and wherein the mouthpiece extends through the wearable portion, receives the fluid from the hose and is configured to allow a user to extract the fluid from the mouthpiece.

According to an embodiment of the present invention, the hose is contained within the wearable portion.

According to an embodiment of the present invention, the uptake valve is contained within the wearable portion.

According to an embodiment of the present invention, the one or more attachment means consist of hook and loop fasteners.

According to an embodiment of the present invention, the thumb strap attachment means is a hoop and loop fastener.

According to an embodiment of the present invention, the apparatus body further comprises a pocket formed on an exterior wall of the apparatus body.

According to an embodiment of the present invention, the apparatus body further comprises a pocket closing means, selected from the group comprising, one or more hook and loop fasteners, one or more snaps, one or more zippers and one or more buttons.

According to an embodiment of the present invention, the apparatus body further comprises a thermal material that encloses the bladder and provides for temperature regulation of the fluid.

According to an embodiment of the present invention, the bladder further comprises a weld seam configured to compartmentalize the liquid, which results in an even disbursement of fluid throughout the bladder.

According to an embodiment of the present invention, the wearable portion is configured to be worn on the forearm of the user.

According to an embodiment of the present invention, the fill cap may be selected from the group comprising a screw top lid, a snap top lid, a reusable lid or a reusable seal.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED DESCRIPTION OF THE INVENTION

The present invention generally relates to wearable hydration apparatuses. In particular, embodiments of the apparatus are configured to be worn on a forearm of a user and provide hydration to the user via a mouthpiece connected to a bladder in the apparatus that is configured to hold liquid such that the liquid is displaced over the entire shape of the user's forearm. In preferred embodiments, the mouthpiece of the apparatus may be engaged through a biting or other action applied to the mouthpiece via the user's mouth.

Figure 1:
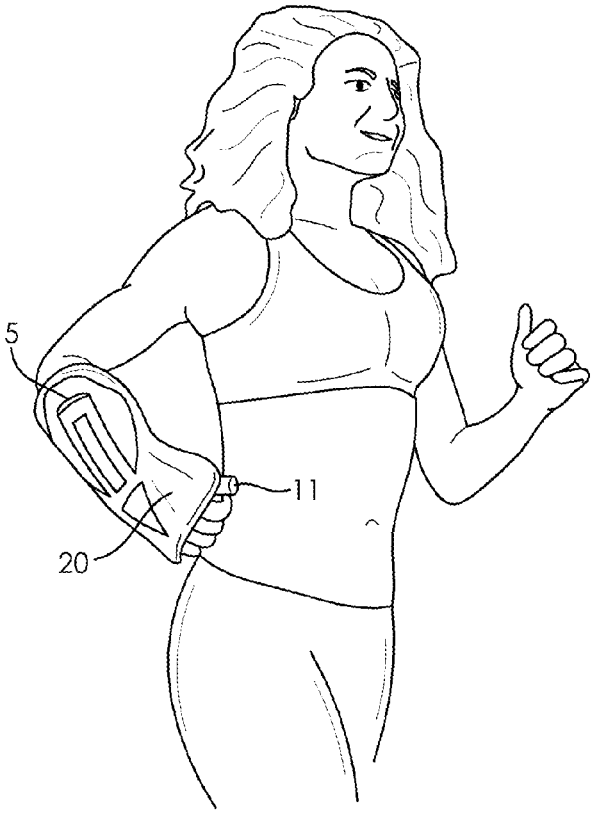
FIG. 1 is an illustration of an exemplary embodiment of the present invention in use by a user.
Figure 2:
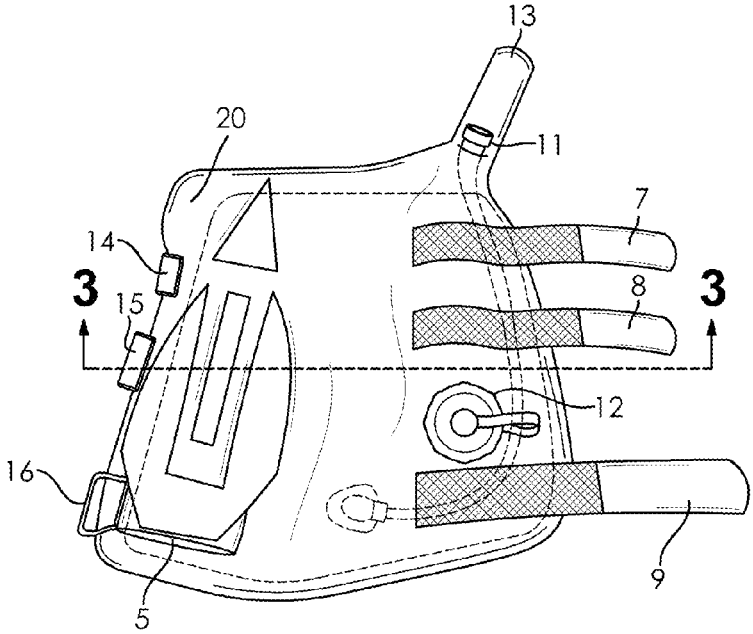
FIG. 2 is a perspective view of an exemplary embodiment of the present invention.
Figure 3:
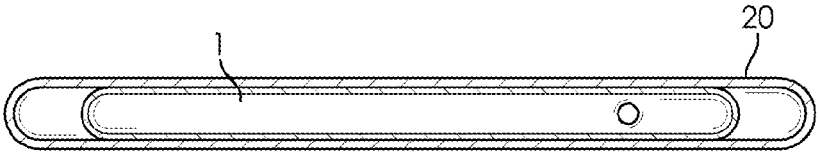
FIG. 3 is a cross-sectional view of an exemplary embodiment of the present invention, showing an interior bladder portion.
Figure 4:
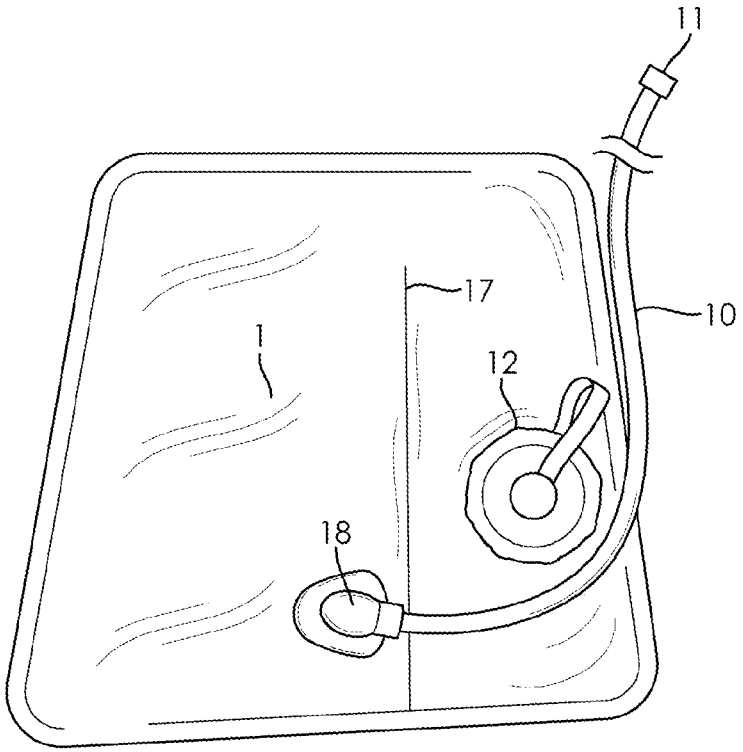
FIG. 4 is a view of an exemplary embodiment of a liquid storage, intake, and dispensing element in accordance with an embodiment of the present invention.
Figure 5:
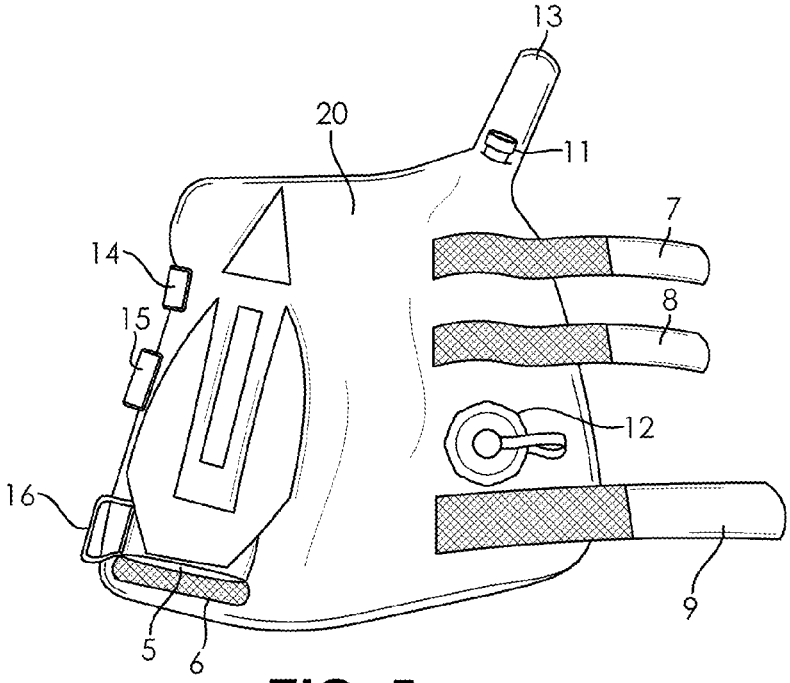
FIG. 5 is a perspective view of an exemplary embodiment of the present invention.

According to an embodiment of the present invention, the hands free hydration apparatus is comprised of an apparatus body comprising a bladder (1) contained in an exterior wearable portion (20). The exterior wearable portion (20) is comprised of one or more attachment means (shown in FIG. 1 as hook and loop straps (7, 8, 9), corresponding loops (14, 15, 16) and hook and loop thumb strap (13)).

According to an embodiments of the present invention, a fill cap extends through the exterior wearable portion (20) and connects to the bladder (1) for filling of the bladder (1) with a fluid of preference by the user. The fill cap (12) is configured to provide a reusable seal for the bladder (1) and may be comprised of a twist-cap, snap-cap, removable lid or other reusable seal. One of ordinary skill in the art would appreciate that there are numerous types of reusable seals that could be utilized with embodiments of the present invention, and embodiments of the present invention are contemplated for use with any appropriate type of reusable seal.

According to an embodiments of the present invention, liquid is poured into the bladder (1) via the fill cap (12) and disbursed evenly throughout the bladder by function of the weld seam (17). Liquid exits the bladder during the user's drinking motion via the uptake valve/hose connector (18) and travels up the hose (10) and out the mouthpiece (11) into the user's mouth via suction.

In a preferred embodiment of the present invention, the bladder (1) is encased within neoprene and sponge material with a front design comprised of EVA foam. One of ordinary skill in the art would appreciate that other materials could be substituted for the neoprene, sponge material and EVA foam, and embodiments of the present invention are contemplated for use with any appropriate materials.

According to an embodiment of the present invention, the exterior wearable portion (20) may further comprise a pocket (5). In a preferred embodiment, the pocket (5) is set at the end most proximal to the elbow of the user. Further, in preferred embodiments, the pocket (5) is closeable with a hook and loop fastener (6). In alternative embodiments, the pocket (5) may be closeable via another closing means (e.g., zipper, button(s), snap(s)). One of ordinary skill in the art would appreciate that both the location and the closing means of the pocket may vary, and embodiments of the present invention are contemplated for use with pockets located anywhere on the exterior wearable portion (20) of the hands free hydration apparatus as well as any type of closing means for the pocket.

According to an embodiment of the present invention, the hands free hydration apparatus is fastened to the arm of user at the forearm via attachment means. In a preferred embodiment of the present invention, these attachment means are secured by passing hook and loop straps (7, 8, & 9) through their respective loops (14, 15, & 16) and fastening them, and by fastening a hook and loop thumb strap (13). In this embodiment, each hook and loop strap (7, 8, 9, & 13), along with their respective loops (14, 15, & 16) function both individually and collectively to secure the device to the arm of the user. As noted above, the attachment means could be any appropriate attachment means, such as zippers, snaps, buttons or other means for securing one end of the hands free hydration device to another, around the forearm of the user (preferably with a second securing point around a thumb of the user). One of ordinary skill in the art would appreciate that there are numerous attachment means that could be utilized with embodiments of the present invention, and embodiments of the present invention are contemplated for any appropriate attachment means.

In a preferred embodiment of the present invention, the bladder (1), fill cap (12), uptake valve/hose connector (18), hose (10), and mouthpiece (11) function collectively as a liquid storage, intake, and dispensing element within the apparatus, with weld seam (17) helping to control liquid disbursement and flow. Further, in this embodiment, the neoprene and sponge material may function as a protective encasement for the bladder (1) and for comfort against the user's arm. Further, in this embodiment, the pocket (5) and its respective hook and loop fastener (6) function as a storage compartment for user's cell phone, mp3 player or other personal items. EVA foam on front of device is for aesthetic purpose.

According to an embodiment of the present invention, a bladder (1), hose (10), uptake valve/hose connector (18), fill cap (12), and mouthpiece (11) are all individually created via plastic curation with molds. The mouthpiece (11) may be secured to hose (10), hose (10) being secured to uptake valve/hose connector (18), which is connected to the bladder (1) along with fill cap (12). After all the previously the parts are properly assembled into a single liquid dispensing apparatus, a weld-seam (17) can created by heat-sealing or ultra-sonic welding in the middle of the bladder. The bladder is then encased and sewn within sponge material and neoprene that have been shaped and cut according to the size of the bladder and shape of the human forearm, with a hole cut through one side of the material through which the fill cap (12) may protrude. One of ordinary skill in the art would appreciate that there are numerous methods for constructing this single liquid dispensing apparatus, and any appropriate method for such construction is contemplated for use with embodiments of the present invention. Further, one of ordinary skill in the art would appreciate that there are numerous methods for producing a seam in the bladder (1) and embodiments of the present invention are contemplated for use with any type of seam or method for producing such a seam in the bladder (1).

According to an embodiment of the present invention, hook and loop straps (7, 8, & 9) and their respective loops (14, 15, & 16) are sewn onto opposite distal ends of the fabric so that when folded, can be fastened to form a cylindrical shape. Further, the pocket (5) may be cut and sewn into one side of the neoprene, and hook and loop fasteners (6) are sewn inside the pocket (5) for closing/fastening. Further, the hook and loop thumb strap (13) is secured to adjacent corner on the opposite side of the device and EVA foam is sewn or glued on outer side of the neoprene for aesthetic design when worn on the user's forearm.

All elements are necessary, however the aesthetic design made of EVA foam is for aesthetic purpose only and could optionally be left out. Other optional elements that could be added or removed would be the pocket (5), additional pockets (e.g., proximal to fill cap (12)) as well as metal or plastic insert to serve as a structural support within the device against forearm of the user. Also a thermal material inside the device would be optional to help insulate and regulate liquid temperature.

In certain embodiments, hook and loop straps (7, 8, 9) and respective loops (14, 15, 16) could be added, removed, reconfigured. In still further embodiments, hook and loop straps (7, 8, 9) and respective loops (14, 15, 16) can be replaced entirely with elastic on the exterior wearable portion (20), allowing the hands free hydration apparatus to be slid on and off.

Further, the bladder (1) could be replaced with a hard container. In still further embodiments, textile materials could be changed for other suitable materials as well. One of ordinary skill in the art would appreciate that there are numerous materials that could be substituted for others, and embodiments of the present invention are contemplated for use with any appropriate materials.

A person would fill the device with water or other liquid beverage, secure it to their arm, and then drink the liquid via the mouthpiece without having to grasp anything.

According to an embodiment of the present invention, a hands free hydration apparatus allows a user to carry liquid hydration with them by displacing the liquid over an entirety of the user's forearm. The hands free hydration apparatus also frees the user's hand for other tasks and adapts to their anatomy for comfort during movement or activity.

According to an embodiment of the present invention, a hands free hydration apparatus utilizes a bladder (1) for holding liquid to provide hydration to a user. In a preferred embodiment, the bladder (1) has a weld seam (17) in the center of it. In this preferred embodiment, the weld seam serves as a divider that compartmentalizes the liquid within the bladder, allowing for even disbursement of the fluid throughout the device. This limits movement of the fluid within the bladder and allows the bladder to conform to the shape of the user's arm.

Further, in preferred embodiments of the present invention, an uptake valve is placed at an end of the bladder most proximal to the user's elbow. This utilizes gravity to enhance the flow of liquid out of the bladder and into the uptake valve during the user's drinking motion.

Embodiments of the present invention overcome three fundamental forces that cause the problem with wearable hydration devices: gravity, fluid dynamics, and inertia. In other devices, gravity causes the fluid to flow away from the uptake valve during the drinking motion which can make drinking impossible, in this invention the fluid flows towards the uptake valve during the drinking motion. The device also combats fluid dynamics, specifically a fluid's tendency to concentrate in a particular area due to gravitational force by utilizing a barrier in the form of a weld seam to compartmentalize the water, which results in an even disbursement of fluid throughout the device, providing additional comfort while wearing. The device also overcomes inertia by being securely fastened to the arm of the user, which reduces bouncing/movement and thus, chafing.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A hands free hydration apparatus, said apparatus comprising:

a wearable portion, comprising a front wall and a rear wall that are sealed on all edges, one or more attachment means, a thumb strap attachment means; and a liquid storage, intake, and dispensing element, comprising a bladder, a fill cap, an uptake valve, a hose, and mouthpiece, wherein said bladder is encased by said wearable portion and is comprised of a single continuously flat front bladder wall and a single continuously flat rear bladder wall that are fused together at a weld seam that defines a first and second compartment, wherein said fill cap is attached to said bladder and extends through an outlet formed in said front wall of said wearable portion to allow for insertion of a fluid into said bladder through said fill cap, wherein said uptake valve is contained within said wearable portion and connected to said bladder and provides for passage of the fluid from said bladder to said hose, wherein said hose is connected to said uptake valve and allows for passage of the fluid from said uptake valve to said mouthpiece, and wherein said mouthpiece extends through said wearable portion proximate to said thumb strap attachment means, receives the fluid from said hose and is configured to allow a user to extract the fluid from said mouthpiece.

2. The apparatus of claim 1, wherein said hose is substantially encased by said wearable portion.

3. The apparatus of claim 1, wherein said uptake valve and said fill cap are separate outlets attached directly to said bladder at two separate locations.

4. The apparatus of claim 1, wherein said one or more attachment means consist of hook and loop fasteners.

5. The apparatus of claim 1, wherein said thumb strap attachment means is a hook and loop fastener.

6. The apparatus of claim 1, further comprising a pocket formed on said front wall of said wearable portion.

7. The apparatus of claim 6, wherein said pocket is configured with a pocket closing means, selected from the group comprising, one or more hook and loop fasteners, one or more snaps, one or more zippers and one or more buttons.

8. The apparatus of claim 1, wherein at least one of said front wall and said rear wall of said wearable portion comprises a thermal material that encloses said bladder and provides for temperature regulation of said fluid.

9. The apparatus of claim 1, wherein said weld seam is configured to compartmentalize the liquid, which results in an even disbursement of fluid throughout the bladder.

10. The apparatus of claim 1, wherein said wearable portion is configured to be worn on the forearm of the user.

11. The apparatus of claim 1, wherein said fill cap is selected from the group comprising a screw top lid, a snap top lid, a reusable lid or a reusable seal.

12. The apparatus of claim 1, wherein said thumb strap attachment means is adjustable.

13. The apparatus of claim 1, wherein said one or more attachment means are connected directly to said front wall of said wearable portion.

14. The apparatus of claim 1, wherein all of said front bladder wall is entirely in contact with all of said rear bladder wall when said bladder is empty.

15. The apparatus of claim 1, wherein said fill cap is attached to said first compartment and said uptake valve is connected to said second compartment.

* * * * *